US012281873B1

(12) United States Patent
Ding et al.

(10) Patent No.: US 12,281,873 B1
(45) Date of Patent: Apr. 22, 2025

(54) SIGHT MOUNT AND RELATED METHOD OF USE

(71) Applicant: Leapers, Inc., Livonia, MI (US)

(72) Inventors: Tai-lai Ding, Northville, MI (US); Tat Shing Yu, Plymouth, MI (US); Kiyokazu J. Nakagawa, Livonia, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 18/600,909

(22) Filed: Mar. 11, 2024

(51) Int. Cl.
*F41C 27/00* (2006.01)
*F41G 11/00* (2006.01)

(52) U.S. Cl.
CPC ..... *F41C 27/00* (2013.01); *F41G 11/003* (2013.01)

(58) Field of Classification Search
CPC ..... F41C 27/00; F41G 11/003
See application file for complete search history.

(56) References Cited

U.S. PATENT DOCUMENTS

| | | | | |
|---|---|---|---|---|
| 8,640,372 | B2 * | 2/2014 | Hochstrate | F41C 23/16 42/75.01 |
| 9,052,160 | B1 * | 6/2015 | Gordon | B23P 6/00 |
| 10,309,752 | B1 * | 6/2019 | Britt | F41G 11/002 |
| 10,955,217 | B2 * | 3/2021 | Saadon | F41C 23/14 |
| 12,000,673 | B2 * | 6/2024 | Zimmer | F41G 1/08 |
| 12,025,407 | B2 * | 7/2024 | Itshaky | F41G 11/008 |
| 12,050,083 | B2 * | 7/2024 | Zimmer | F41G 11/003 |
| 12,188,737 | B1 * | 1/2025 | Shen | F41C 23/20 |
| 2019/0310045 | A1 * | 10/2019 | Odle | F41A 21/34 |
| 2024/0191974 | A1 * | 6/2024 | Jørgensen | F41G 11/002 |
| 2024/0271912 | A1 * | 8/2024 | Cutrer | F41G 11/003 |
| 2024/0337466 | A1 * | 10/2024 | Lee | F41G 11/003 |

OTHER PUBLICATIONS

Classic Army, MP5 Front Sight Mount, (https://www.airsoftglobal.com/shop/classic-army-mp5-front-sight-mount-p-9061.html), downloaded Nov. Nov. 28, 2023.
Gibbous, MP5 Front Sight Mount, (https://gibbousoutfitters.com/products/fsm5-front-sight-mount-mp5), downloaded November Nov. 28, 2023.
Safara, J-Tech Mp5/G3 Front Rail Adapter, (https://www.safarasoftair.com/en/j-tech-mp5-g3-front-rail-adapter), downloaded Nov. Nov. 28, 2023.

* cited by examiner

*Primary Examiner* — Michelle Clement
(74) *Attorney, Agent, or Firm* — Warner Norcross + Judd LLP

(57) ABSTRACT

A weapon mount is provided to connect an accessory to a weapon adjacent a sight. The mount can include a main body, a forward projecting first arm and a locking plate. The main body can engage a rear of the sight, for example, a front sight post, and the locking plate can engage a front of the sight. The locking plate, main body and mount can be centered on the post via a centering fastener projecting through a center plate hole of the locking plate, and can be clamped to the sight post via first and second fasteners projecting through the locking plate and engaged with the first arm and a second arm which can be part of the main body or a modular body. The modular body can be slidably joined with the main body via a guide rail and corresponding slot. A related method of use is provided.

16 Claims, 8 Drawing Sheets

SIGHT MOUNT AND RELATED METHOD OF USE

BACKGROUND OF THE INVENTION

The present invention relates to a weapon mounting system, and more particularly to a firearm mount for mounting accessories to a weapon such as a firearm.

Many modern sporting and military firearms include a handguard that extends forward of a receiver, and generally around a barrel of the firearm. The handguard prevents contact between the user and the barrel, thereby protecting the user when the barrel heats up after extended periods of fire. From the manufacturer, many handguards on stock firearms have inadequate or inaccessible mounting locations. Some stock firearm handguards are void of rails or other surfaces upon which to mount accessories, such as lights, lasers, pressure switches and other items.

For example, in an MP5 firearm, manufactured by Heckler & Koch of Germany, or variants thereof, a tube extends above the barrel, away from the receiver of the firearm. A stock handguard over that tube is rather spartan and simple, without any decent accessory rails or mounts. Due to the front sight projecting upward adjacent the front of the stock handguard and mounted to the barrel, the handguard and tube have no good attachment points for accessories or other components. Thus, most handguards and rails for the MP5 are secured only to the receiver, or alternatively and separately under the tube. This reduces the amount of space for accessory mounting, particularly lights, lasers and pressure switches for the same.

Accordingly, there remains room for improvement in the field of mounting rails and handguards, and in particular, the way that they are secured to a firearm and their orientation relative to certain parts of the firearm for ease of access and actuation.

SUMMARY OF THE INVENTION

A weapon mount is provided to connect an accessory to a weapon adjacent a sight. The mount can include a main body, a forward projecting first arm and a locking plate. The main body can engage a rear of the sight, for example, a front sight post, and the locking plate can engage a front of the sight for securement of the mount to the sight.

In one embodiment, the locking plate, main body and mount can be centered on the post via a centering fastener projecting through a center plate hole of the locking plate and can be clamped to the sight post via first and second fasteners projecting through the locking plate and engaged with the first arm and a second arm which can be part of the main body and/or a modular body.

In another embodiment, the main body can include a front edge and the first arm can extend forwardly of the front edge. The locking plate can face toward the front edge and the sight of the weapon can be disposed between the front edge and the locking plate. The locking plate can be urged toward the main body to clamp the sight, which can be in the form of a sight post, between the main body and locking plate.

In still another embodiment, the locking plate can define a first hole through which a first fastener projects and a second hole through which a second fastener projects. The first fastener can join the locking plate to the first arm. The second fastener can join the locking plate to a second arm.

In yet another embodiment, the locking plate can define a center plate hole distal from the first hole and second hole, optionally between those holes. These holes can all be defined in a forward surface of the locking plate facing away from the sight post.

In even another embodiment, a modular body can be joined with the main body and the locking plate opposite the first arm, the modular body including or forming the second arm. A first rail can be joined with the main body, and a second rail joined with the modular body. The first rail and the second rail can slidably join with one another, thereby joining the main body and the modular body.

In a further embodiment, the guide rail can be a dovetail rail, and the guide rail slot can be a dovetail recess that receives the dovetail rail.

In still a further embodiment, the main body can include an integrally formed second arm that extends parallel to the first arm and is configured to extend on an opposite lateral side of the sight post when the mount is installed relative thereto. The first arm and second arm can straddle the sight post, and the locking plate can be secured to the front ends of each of the arms with respective first and second fasteners.

In yet a further embodiment, a first elastomeric spacer can be disposed around the first fastener and a second elastomeric spacer disposed around the second fastener. The first elastomeric spacer is located between the locking plate and the first arm, and the second elastomeric spacer is located between the locking plate and the modular body. The elastomeric spacers can provide variability in the distance between the front edge of the main body and the rear face of the locking plate to accommodate sight posts of varying widths.

In even a further embodiment, the main body can include a plate that extends rearward from the sight post. The plate can include the connector. The connector can be a plurality of holes defined by the plate and configured to receive M-LOK, Key Mod or other type connectors of accessories to mount to the main body.

In another embodiment, the main body can include an upper mounting panel and a first side mounting panel extending laterally away from the upper mounting panel at an angle such as 45 degrees. The modular body can include a second mounting panel extending away from the upper mounting panel opposite the first side mounting panel at an angle, such as 45 degrees. The side panels can extend downward along sides of a tube which can house a cocking lever rod or slide of the weapon. Where included, certain connector holes can be located on both the upper panel and the 45 degree side panels, allowing for the attachment of lights, pressure switches and other accessories in a tactical setup.

In still another embodiment, the mount can facilitate mounting of an accessory, such as a light, a laser, a sling mount, a grip, a hand stop, a rail, a pressure switch or other accessories. The accessory can mount to a connector which can be in the form of a hole of varying shapes and sizes.

In still another embodiment, a method is provided. The method can include placing a main body including at least one connector configured to connect an accessory to the main body so that a front edge of the main body engages a rear surface of a front sight post of weapon, with a first arm extending forwardly of the front edge along a first lateral side of the sight post, a second arm extending forwardly of the front edge along a second lateral side of the sight post; placing a locking plate facing toward the front edge so that the sight post is sandwiched between the locking plate and the front edge, the locking plate defining a first hole through which a first fastener projects, the first fastener joining the locking plate to the first arm, the locking plate defining a center plate hole distal from the first hole, the locking plate defining a second hole through which a second fastener projects, the first hole, second hole and center plate hole facing forwardly of the sight post; and tightening a centering fastener in the center plate hole of the locking plate to engage a center sight hole defined by the sight post to center the main body relative to the sight post between the first lateral side and the second lateral side.

In yet another embodiment, the method can enable a user to connect the accessory to the mount while the main body, first arm, second arm and locking plate are disposed around and secured to the sight post holding the main body and at least one connector fixedly rearward of the sight post.

The current embodiments provide a weapon mount that joins easily and rigidly to a variety of firearms, including but not limited to an MP5 firearm or variants thereof. The mount can be directly attached to a front sight of a weapon, such as a firearm, without permanent modifications to the weapon, and can be compatible with standard handguards on stock weapons. Where included, the center fastener can easily and consistently center the mount relative to the sight, for example a sight post, which in turn can center the main body relative to the centerline of the weapon and allowing precise alignment of an associated accessory. This can provide precise alignment of that mount and thus the accessory relative to the weapon. Where included, the locking plate can combine all fasteners used with the mount in a forward-facing orientation to ease assembly and quickly clamp and center the mount relative to the sight. A user thus need not tighten multiple screws from different locations and orientations relative to the mount. Where included, the elastomeric spacers can allow the mount to accommodate a variety of sights which might be differently sized or out of tolerance. Where included, the modular body can make assembly and securement of the mount to the sight post easier and more convenient. Such a modular body also can offer flexibility with modular design, including options for varying numbers of M-LOK slots, direct attachment of pressure switches and/or a two-piece modular concept.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
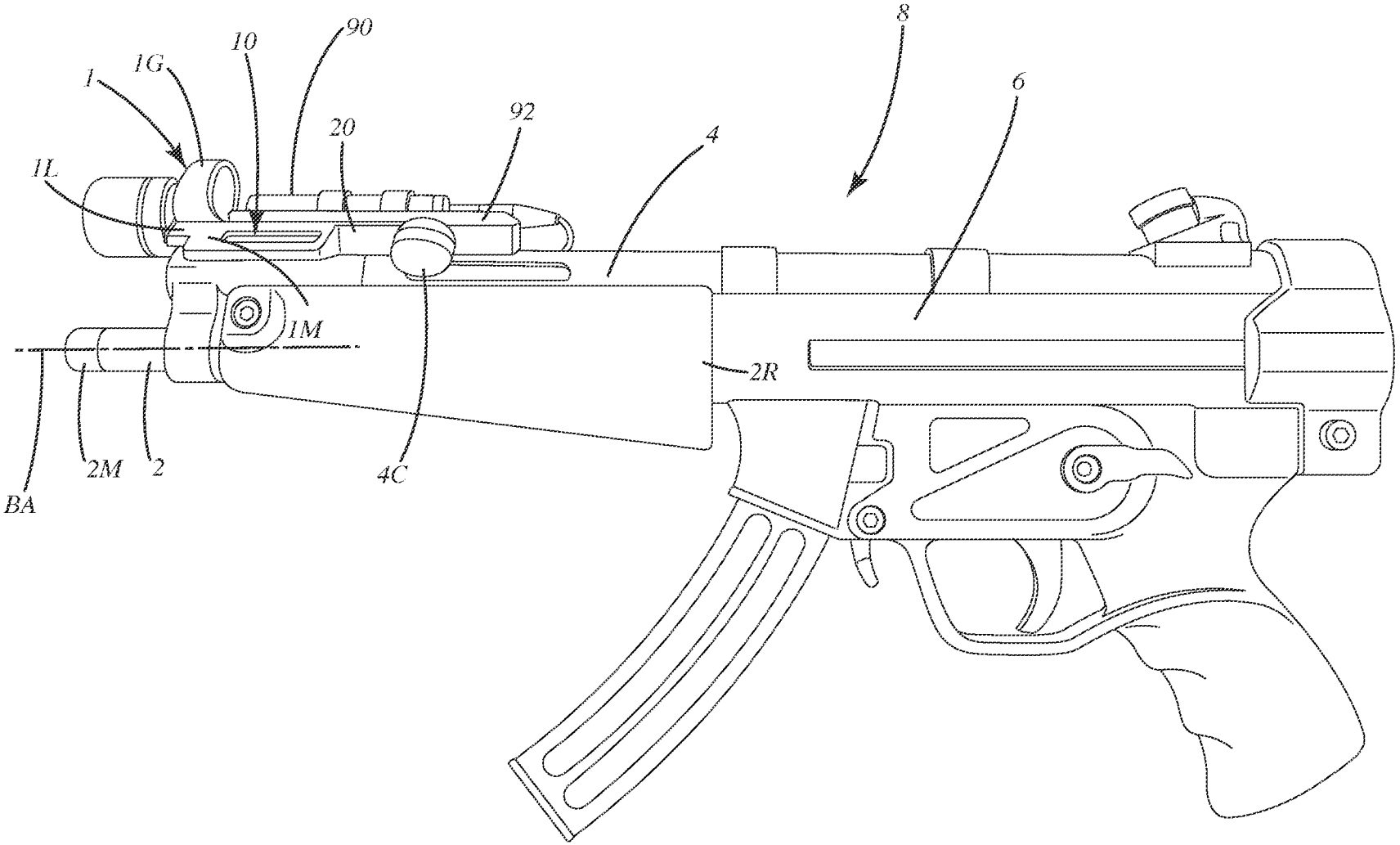
FIG. 1 is a side view of the mount of a current embodiment secured to a weapon with an exemplary light accessory joined to the mount and thus to the weapon.
Figure 2:
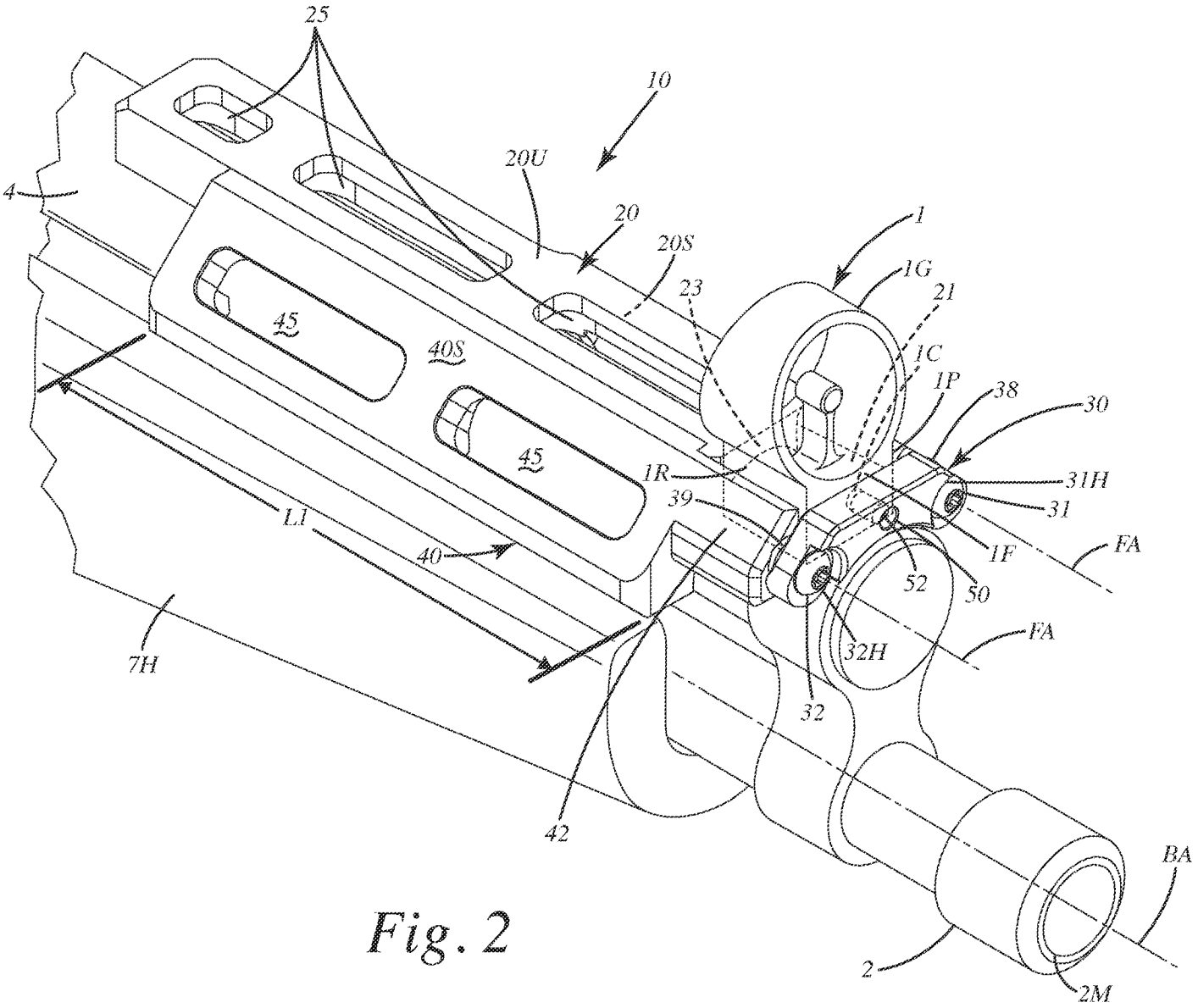
FIG. 2 is a perspective view of the mount on the weapon and mounted to a front sight post thereof.
Figure 3:
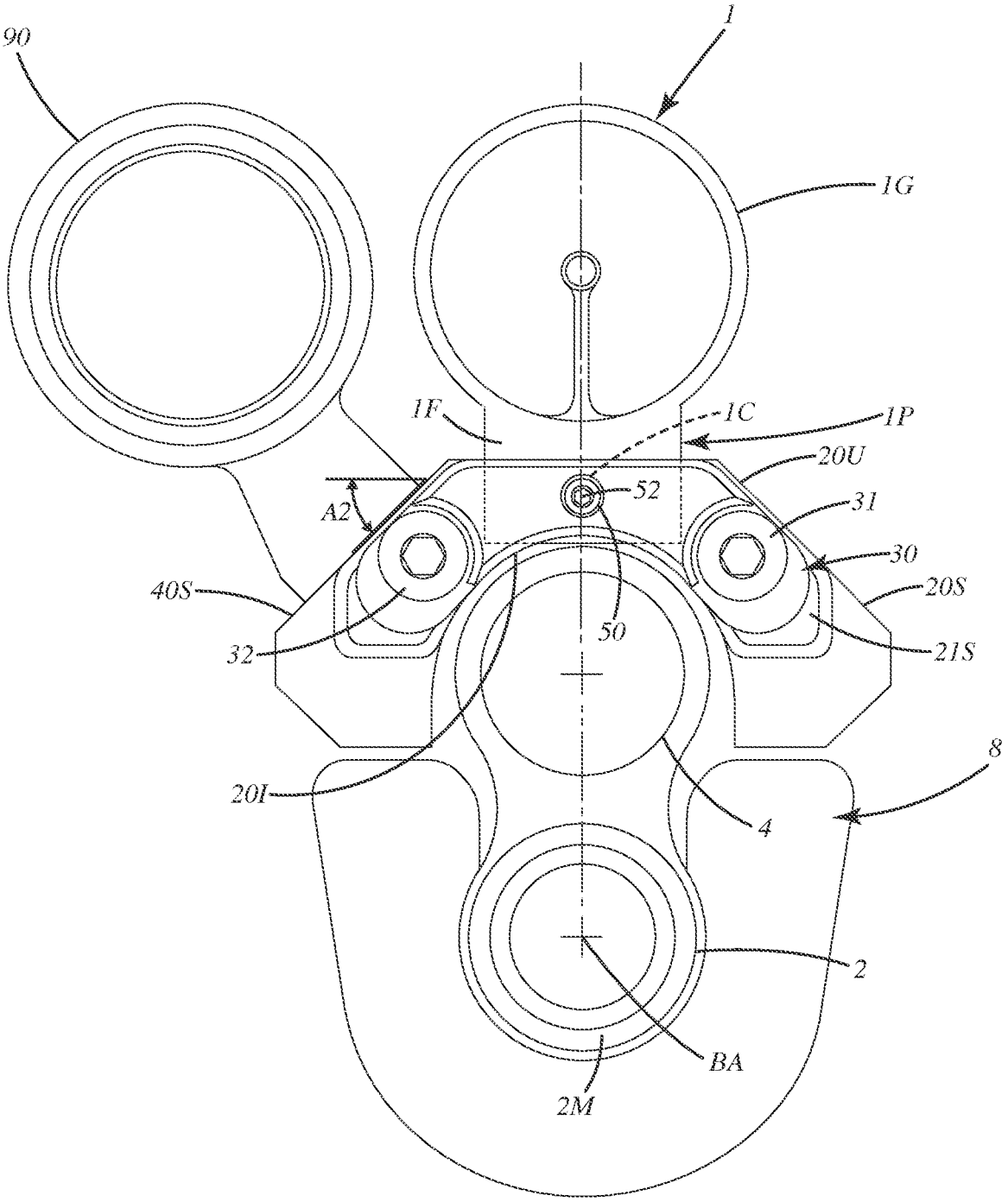
FIG. 3 is a front view of the mount.

A current embodiment of the weapon mount is shown in FIGS. 1-3 and generally designated 10. The weapon mount 10, which can also be referred to as an accessory mount or mount in general, optionally is configured to be secured to a front sight 1 of a weapon 8, such as a firearm. The weapon 8 can be a sporting, military or hunting rifle or pistol, for example an MP5 from Heckler & Koch of Germany, variants thereof and other firearm or weapon systems that include a barrel, receiver and an optional cocking lever housing and/or gas tube. The mount 10 can include a main body 20 that extends rearward of the front sight 1, which can be a front sight post, and can include a first arm 21 that extends past a first lateral side 1L forward of the main body 20. A locking plate 30 can be secured forward of the front sight 1 to the first arm 21 with a first fastener 31. The locking plate 30 can be secured to a second arm 42 with a second fastener 32 which optionally can be part of a modular body 40 or integral with the main body 10 itself as described below. The locking plate 30 can include a center plate hole 50 through which a centering fastener 52 is installed to engage a center sight hole 1C defined by the sight 1 of the weapon to center the locking plate 30 and thus the mount 10 relative to the sight 1.

Turning now to FIGS. 1-3, the firearm mount 10 and components of the weapon 8 will now be described in further detail. As mentioned above, the mount 10 mounts over and above the cocking lever housing 4, as well as a barrel 2 and stock handguard of the firearm. The mount can be installed to the front sight 1, which can be a front sight post including a main post 1P that extends upward to a ghost ring or circle aperture 1G above the main post 1P. The mount can engage the main post 1P below the ghost ring 1G, optionally without engaging the handguard and/or cocking lever housing 4, also referred to as a tube herein. The barrel 2 can include a muzzle end 2M and a receiver end 2R, with a longitudinal axis BA extending therebetween. The receiver end 2R can extend from the receiver 6. The cocking lever housing or tube 4 can extend forwardly from the receiver 6. In some cases, that lever housing 4 can extend as a tube from a portion of the receiver 6 over the barrel 3. The components of the housing 4 and receiver 6 can be stamped from metal parts or otherwise formed or machined. The cocking lever housing 4 can house a cocking lever 4C that is designed to move a bolt within the receiver 4 to load a bullet in a chamber of the associated barrel 2.

With further reference to FIGS. 1-4, the mount 10 can include the main body 20. The main body 20 can include an upper panel 20U and a first side mounting panel 20S extending laterally away from the upper mounting panel at an angle A1, which optionally can be about 45 degrees or some other angle. The main body optionally can be joined with a modular body 40 as described below, which modular body 40 can include a second side panel 40S extending laterally away from the upper panel at an angle A2, which optionally can be about 45 degrees or some other angle. The side panels can extend away from one another and the upper panel on opposite sides of the tube 4. The configuration of the upper and side panels optionally can be such that they encase or at least partially surround an upper portion of the tube 4 of the weapon rearward of the sight 1.

Figure 4:
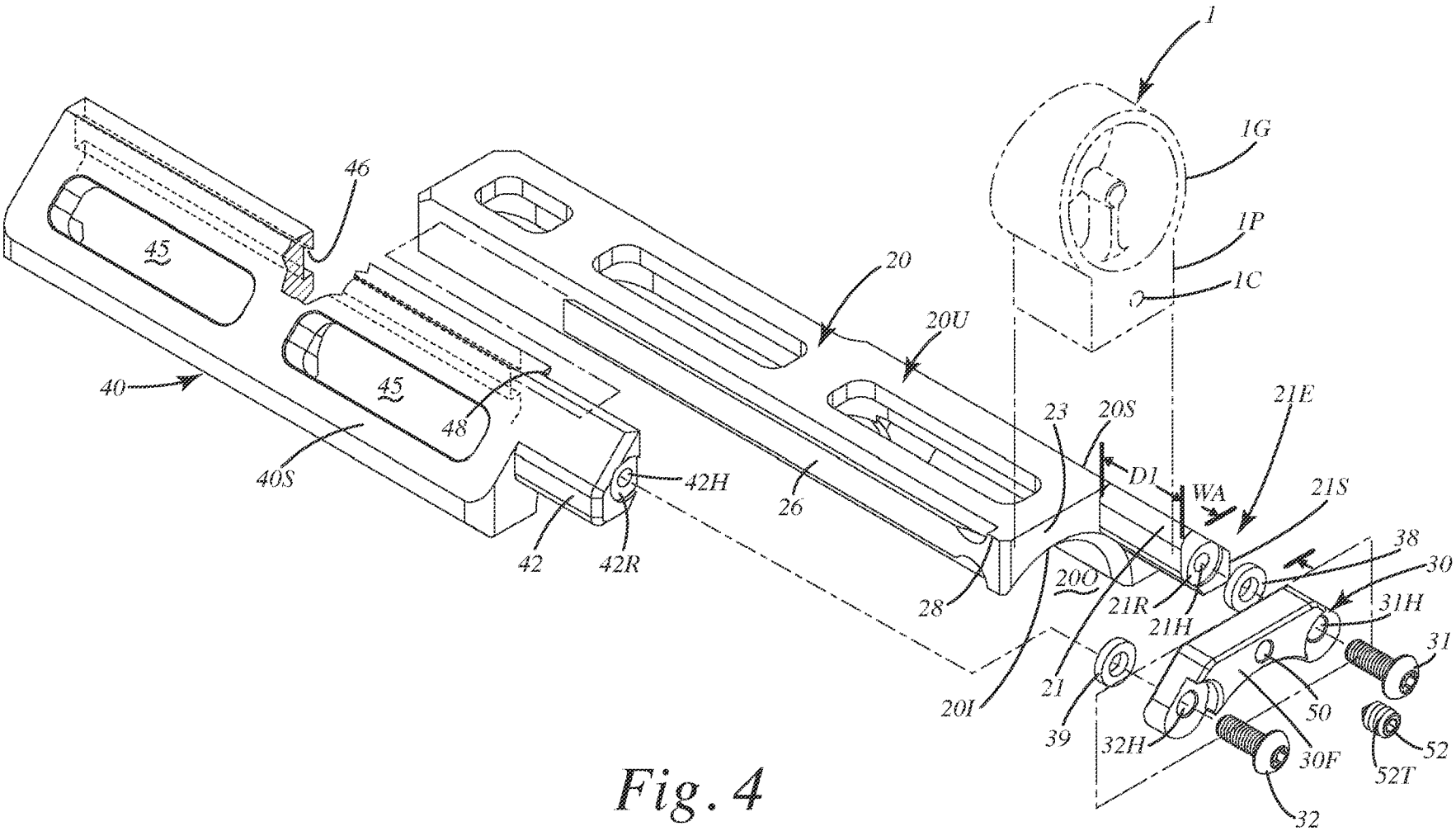
FIG. 4 is an exploded view of the mount showing a main body, an elongated modular body and a locking plate.

Optionally, as shown in FIG. 4, the main body can include an interior surface or contour 201. This interior contour can be arcuate or curvilinear as shown there. The interior surface can extend under the upper panel and through the side panel. The interior surface, where arcuate, can fit around or generally accommodate the tube 4 of the weapon rearward of the sight. The modular body 40 optionally can include a similarly arcuate or curvilinear contour to fit around the tube 4. Of course, the interior contour 201 can be angular in other applications to fit around the tube with more spacing between the tube and the mount.

The main body 20 shown in FIGS. 2 and 4 can include one or more connectors 25 which are configured to connect an accessory to the main body. The one or more connectors can be one or more holes, recesses, slots or other apertures defined by the panels or plates. The connectors can be in the form of elongated slots with rounded ends. The connectors can be configured to receive M-LOK, Key Mod or other type connectors of accessories to mount the same to the main body. The connectors can be aligned with the length of the panels on the various sides of the main body and modular body where included.

The accessory 90 can be a light as shown, a laser, a switch, a grip, a stop or any other type of accessory. The accessory also can be actuated by a pressure switch 92. The light 90 can be attached to the modular body 40, while the pressure switch or other type of actuator or switch 92 can be joined with the main body. More particularly, the switch can be joined with the side panel 40S at the angle A2 while the pressure switch 92 can be joined with the upper panel 20U atop the main body and behind the sight 1. The light itself can extend forwardly past a portion of the sight 1.

The main body 20, as mentioned above, can include a first engagement surface 23 configured to engage a first sight surface 1R of the sight 1, which can be at the rear of the sight post 1P. The first engagement surface 23 can be a front edge of the upper panel 20U or some other forward edge or portion of the main body. The front edge can face forwardly toward the muzzle 2M, and can be flat or planar depending on the application. The main body can include a first arm 21 that can extend forwardly beyond the main body optionally adjacent and along a first lateral side 1L of the sight 1, beyond the first engagement surface 23 or front edge. The first sight surface 1R can be transverse and/or perpendicular to a first lateral side 1L and second lateral side 1R of the sight. The first sight surface 1R can be parallel to a second sight surface which can be a forward surface of the sight or sight post 1P.

As shown in FIG. 4, the first arm 21 can be integrally formed with the main body 20 as a single piece unit. The first arm can be of a smaller width WA than the width WS of the side panel 20S. The arm 21 can include a flat or planar inner side 211 that faces the first lateral side 1L. The arm can extend parallel to the barrel axis BA when the mount is installed and can terminate at a distal end 21E. The distal end 21E can define a recess 21R bounded by a shoulder 21S along an outer periphery thereof. A first arm fastener hole 21H can be defined and optionally centered within the recess 21R. The recess 21R optionally can be configured to receive an elastomeric spacer or washer 38 that can be seated or sandwiched between the locking plate 30 and the arm 21. The elastomeric spacer optionally can be an O-ring or washer constructed from rubber, silicone, polymers or other elastomeric materials. Optionally, a second arm 42 of the module body can define a similar recess 42R and shoulder 42S, along with a second arm fastener hole 42H.

The first elastomeric spacer 38 and a second elastomeric spacer 39 described below can be compressed within the recess between the locking plate and the arms when the locking plate is secured with fasteners. For example, as shown in FIG. 2, the first elastomeric spacer 38 can be disposed around the first fastener 31. The second elastomeric spacer 39 can be disposed around the second fastener 32. The first elastomeric spacer can be located between the locking plate 30 and the first arm 21, and the second elastomeric spacer 39 can be located between the locking plate 30 and the modular body 40.

Further optionally, in some applications, the arm can include a locating counter (not shown) to receive a portion or lobe of the plate to align the locking plate with the arm, and more particularly to align the first fastener hole 31H defined by the plate with the first arm fastener hole 21H to facilitate installation of the first fastener 31 into those holes to attach the plate to the main body around the sight. The first arm fastener hole 21H can be defined within the recess 21R distal and offset from the contour, which can project beyond the recess and around at least a portion of the hole 21H. The contour in some cases can be a pin (not shown) that fits in a corresponding pin hole in the locking plate to facilitate alignment. Other alignment mechanisms are contemplated for the fastener holes and fasteners.

With reference to FIGS. 2-4, the locking plate 30 can face toward the front edge 23 of the main body. The plate can be configured so the sight 1 and in particular the main post 1P of the sight is disposed between the front edge and the locking plate, so that when the fasteners 31 and 32 are tightened, the main post 1P is clamped between the front edge and locking plate. The locking plate 30 can define a first hole 31H through which a first fastener 31 projects. The first hole optionally is unthreaded. That first fastener 31 can extend through the locking plate, and the spacer where included, and into the hole 21H, which optionally can be threaded. The first fastener when disposed through the plate and into the hole 21H can join the locking plate 30 to the first arm 21. The locking plate 30 can define a second hole 32H through which a second fastener 32 projects. The second hole optionally is unthreaded. That second fastener 32 can extend through the locking plate, and the spacer where included, and into the hole 42H, which optionally can be threaded. The second fastener when disposed through the plate and into the hole 42H can join the locking plate 30 to the second arm 42.

Optionally, the fasteners 31 and 32 can include heads. The plate 30 can define head recesses to accommodate the heads. Further optionally, as shown in FIGS. 2 and 4, the fastener holes 31H, 32H and the fasteners 31, 32 can have longitudinal fastener axes FA that are parallel to the barrel axis BA. The locking plate and front surface optionally can be perpendicular to the longitudinal axis BA of the barrel.

The locking plate 30 also can define a center plate hole 50 distal from the first hole 31H and second hole 32H. The first hole, second hole and center plate hole can be defined in a forward surface 30F of the locking plate 30. The center plate hole can be defined midway between the first hole and the second hole. The center plate hole, first hole and second hole optionally can be defined in a common plane P1 extending though the locking plate rearward of the forward surface 30F. The center plate hole can be threaded to receive a centering fastener 52. The centering fastener can be a screw, for example a set screw, optionally including a tapered or conical point 52T. The point can be configured to engage a center sight hole 1C defined by the sight 1 and in particular at the center of the sight post 1P between the first 1L and second 1R lateral sides of the sight. This center sight hole 1C can be formed by the original equipment manufacturer of the sight and sight post, and optionally the weapon. This center sight hole 1C can be defined in the side to side center of the second sight surface IF defined at the front of the sight 1 and optionally on the front of the main post 1P. Upon this engagement and tightening of the fastener 52, the locking plate 30 and the attached main body can be consistently and precisely centered on the sight 1 and in particular the main sight post 1P.

With reference to FIGS. 2 and 4, the mount 10 can include the modular body 40 as described above. This modular body can include the side panel 40S with corresponding connectors 45. An accessory, such as a light 90 or other accessory, can be fastened to the modular body via these connectors. The modular body and thus any attached accessory thereto therefore can be selectively attachable to and removable from the main body and locking plate via the above noted second fastener 32, and perhaps another feature as described below. As with the first fastener, the second fastener 32 can project through the faster hole 32H and into the second arm fastener hole 42H into which it can be threaded. The elastomeric spacer 39 can be disposed there between and optionally within a recess 42R defined by the distal end of the second arm 42. The modular body and the second arm 42 can extend generally in parallel to the first arm 21 as well as the barrel axis BA. The second arm 42 can be configured for positioning adjacent the second lateral side surface 1R opposite the first lateral side surface 1L. Optionally, like the first arm, the interior surface of the second arm may or may not engage the respective lateral side surface 1R of the sight 1.

As shown in FIG. 2, when the mount 10 is mounted to the front sight 1, the forward edge 23, the first arm 21, the second arm 42 and the locking plate 30, generally surround or are disposed around that front sight and the main post 1P of the sight. When the fasteners 31 and 32 are tightened, they bring the rear surface of the locking plate toward the forward ends of the first and second. Where included, the elastomeric spacers are compressed between the locking plate and the ends of the arms, optionally compressing within the respective recesses defined by the ends of the arms. The centering fastener 52 previously can be tightened to center the locking plate and main body relative to the sight post, which again can be rigidly and immovably attached to the tube and/or barrel of the firearm. Upon this compression of the sight post between the locking plate and the main body, the mount effectively clamps onto the sight post in a fixed and rigid configuration and orientation. This optionally is accomplished without modifying the handguard 7H, the tube 4 or other components of the weapon, and further optionally via only interaction of the mount with the front sight post and at most perhaps the tube 4 via the interior of the mount contacting it in some applications. Thus, no modification or attachment to the handguard of other elements besides the sight is used to attach the mount and thus the accessory to the weapon.

As mentioned above, the modular body 40 can be removably attached to the main body and/or the locking plate, and thus, so can any accessory be attached thereto for easy replacement or change-out. The second fastener 32 can be used to secure the second arm 42 and thus the modular body to the locking plate. The modular body 40 however, can include an interlocking feature 46 that is removably joinable and interfitting with a corresponding interlocking feature 26 of the main body. Optionally, as shown in FIG. 4, the first interlocking feature 26 can be a first rail joined with the main body 20. The second interlocking feature 46 can be a second rail joined with or defined by the modular body. The first rail and second rail can be slidably joined with one another such that the first rail can be slid relative to the second rail and vice versa. Although shown with the second rail 46 being defined as a recess or slot on the modular body, and the first rail 26 being defined as a projection on the main body, these components can be reversed such that the recess is defined in the main body and the projection is included on the modular body.

Optionally, as shown in FIG. 4, the first rail 26 can be in the form of a dovetail rail. The second rail 46 can be in the form of a dovetail recess or slot that receives the dovetail rail 26. Of course, other shapes of these rails and recesses can be used to movably connect and/or interlock the modular body relative to the main body. Indeed, the interlocking features may not even be rails and instead can be fasteners, cams, clamps or other movable components.

Further optionally, the interlocking rails or other features can be set up to provide a fixed amount of movement or sliding relative to one another. For example, the main body can include a shoulder or stop 28 joined thereto, adjacent an opening 200 which can be defined between the front edge 23, the arm 21 and the locking plate 30. A corresponding shoulder 48 can be included on the modular body 40, rearward or adjacent the second arm 42. The shoulder 48 can engage the stop 28 when the modular body 40 is slid or moved far enough forward relative to the main body 20 and the second arm 42 optionally projects forward of the forward edge 23 the same distance D1 as the first arm 21. Of course, other stops and limiters can be utilized to provide precise movement and positioning of the modular body relative to the other components.

A method of using the weapon mount 10 of the current embodiment will now be described with reference to FIGS. 1-4. Generally, the method can comprise placing a main body including at least one connector configured to connect an accessory to the main body so that a front edge of the main body engages a rear surface of a front sight post. A first arm can extend forwardly of the front edge along a first lateral side of the sight post. A second arm can extend forwardly of the front edge along a second lateral side of the sight post. The method can include placing a locking plate facing toward the front edge so that the sight post is sandwiched between the locking plate and the front edge. The locking plate can define a first hole through which a first fastener projects. The first fastener can join the locking plate to the first arm. The locking plate can define a center plate hole distal from the first hole. The locking plate can define a second hole through which a second fastener projects.

Optionally, the first hole, second hole and center plate hole can face forwardly of the sight post, and can be aligned with the barrel axis. The method can include tightening a centering fastener in the center plate hole of the locking plate to engage a center sight hole defined by the sight post to center the main body relative to the sight post between the first lateral side and the second lateral side. A user can connect the accessory to the mount while the main body, first arm, second arm and locking plate are disposed around and secured to the sight post holding the main body and at least one connector fixedly rearward, forward and/or adjacent the sight post.

The method can include tightening the first fastener to compress a first elastomeric spacer between the locking plate and the first arm and tightening the second fastener to compress a second elastomeric spacer between the locking plate and the second arm. The method can include sliding the second arm relative to the main body such that a guide rail moves relative to a guide rail slot. The method can include aligning the first fastener, the second fastener and the centering fastener so that each are parallel in length to one another.

Figure 5:
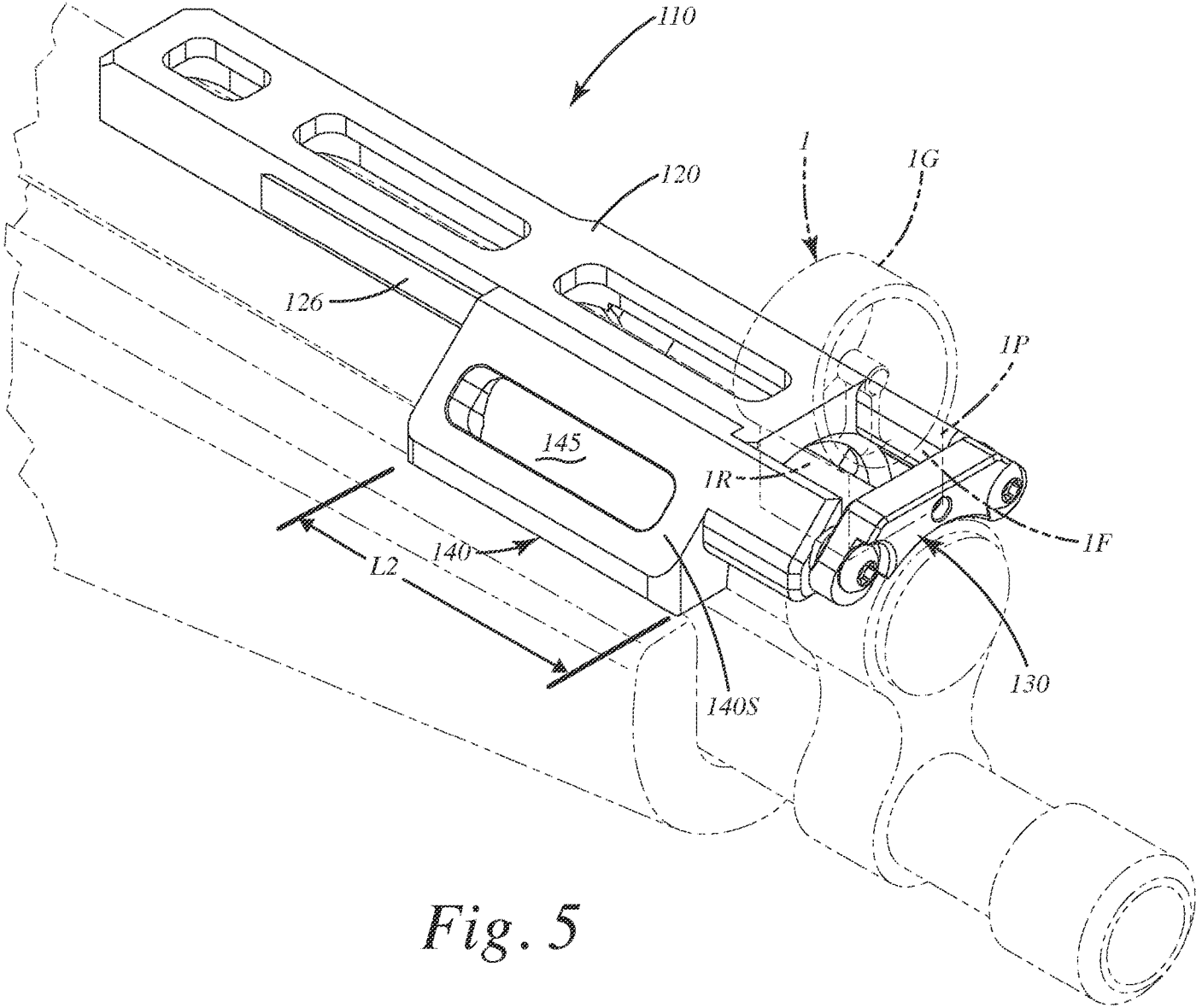
FIG. 5 is a perspective view of the mount showing the main body, a first alternative shorter modular body and a locking plate in assembled form.

A first alternative embodiment of the mount is shown in FIG. 5 and generally designated 110. This mount can be similar to that of the current embodiment in structure, function and operation with several exceptions. For example, the mount 110 can include the main body 120 and a locking plate 130 secured thereto with fasteners, which generally clamps the main post 1P of a front sight 1. In this embodiment, however, the modular body 140 only includes a single connector 145 in the form of a single slot. The modular body and its side panel 140S also are a shorter length L2 than the length L1 of the modular body 40 shown in FIG. 2. This in turn can reduce the overall size of the modular body and the mount 110, yet still provide adequate area to mount an accessory via the mouth 110 to a weapon.

Figure 6:
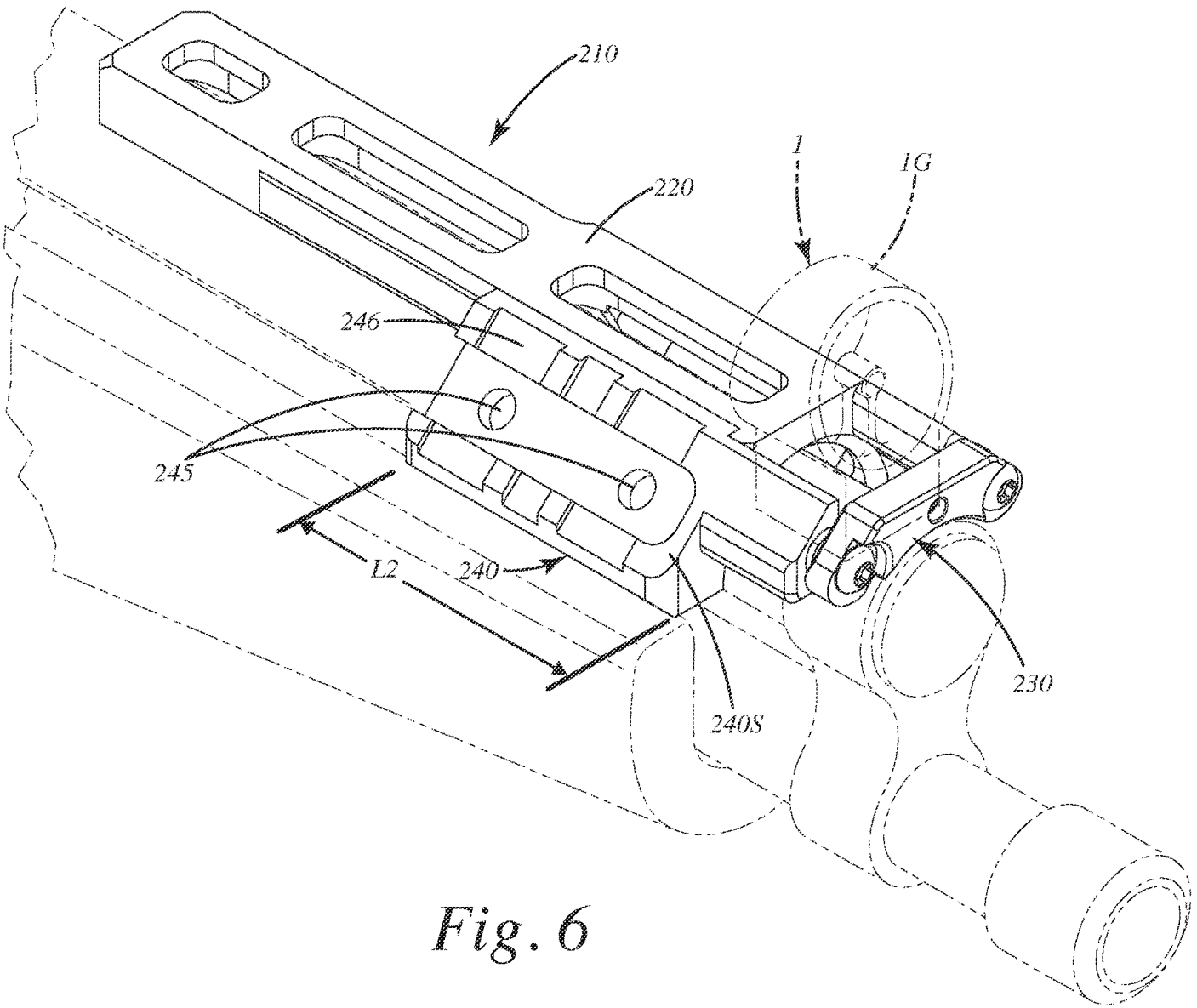
FIG. 6 is a perspective view of the mount showing the main body, a second alternative rail modular body and a locking plate in assembled form.

A second alternative embodiment of the mount is shown in FIG. 6 and generally designated 210. This mount can be similar to that of the current embodiment in structure, function and operation with several exceptions. For example, the mount 210 can include the main body 220 and a locking plate 230 secured thereto with fasteners, which generally clamp to the main post 1P of a front sight 1. In this embodiment, however, the modular body 240 can be in the form of a picatinny rail 246 that extends from the main side panel 240S. One or more additional connector holes 245 can be defined in the picatinny rail to assist in further connecting or mounting an accessory to the modular body 240. This modular body 240 also can include a length L2 that is less than the length L1 of the modular body 40 of the embodiment above.

Figure 7:
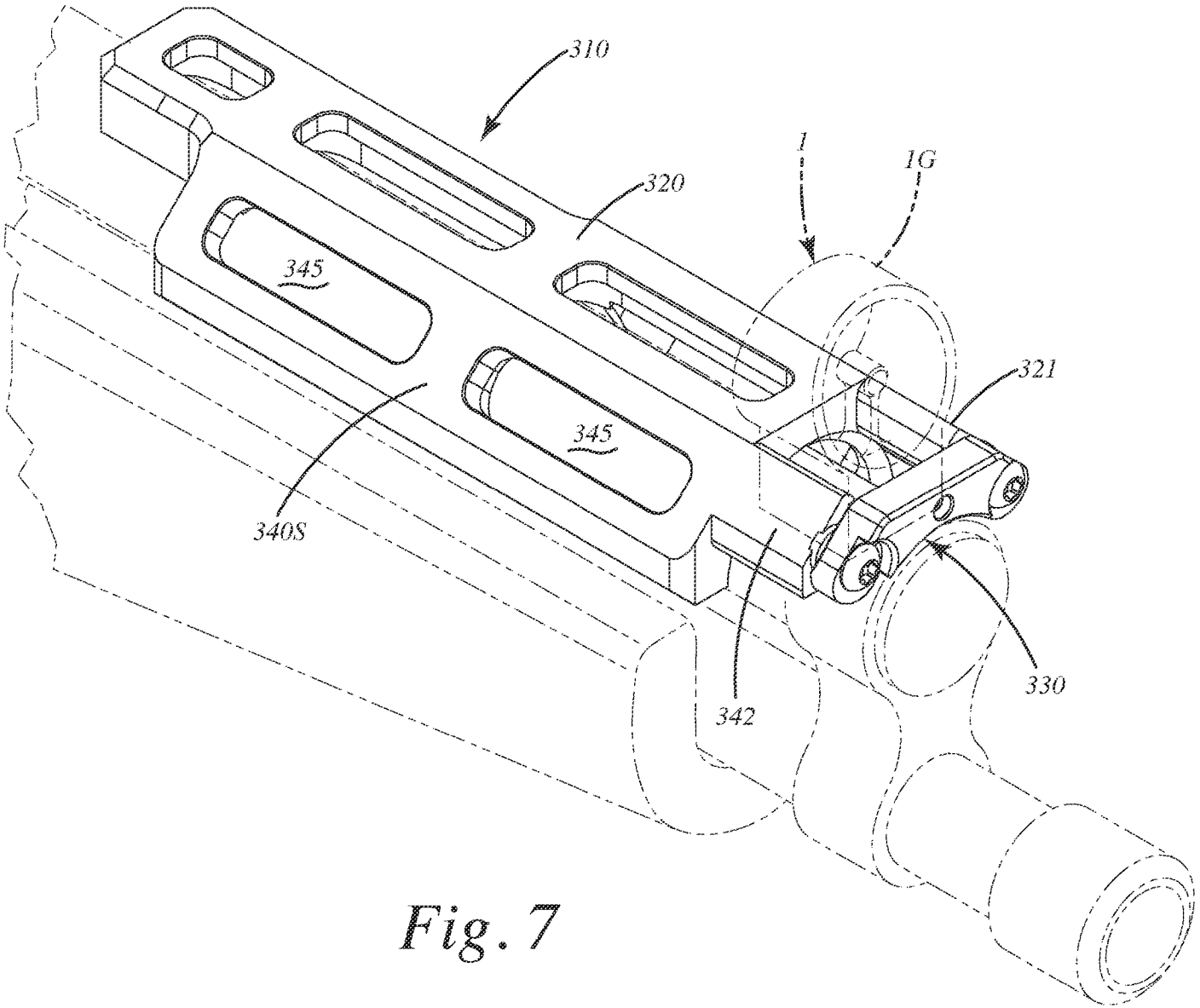
FIG. 7 is a perspective view of a third alternative embodiment of the mount showing the main body and a locking plate in assembled form.

A third alternative embodiment of the mount is shown in FIG. 7 and generally designated 310. This mount can be similar to that of the current embodiment in structure, function and operation with several exceptions. For example, the mount 310 can include the main body 320 and a locking plate 330 secured thereto with fasteners, which generally clamp to the main post 1P of a front sight 1. In this embodiment, however, the modular body is absent, and the main body 320 includes an integral side panel 340S. The second arm 342 also can be integrally formed with the main body, along with the first arm as a single piece unit.

Figure 8:
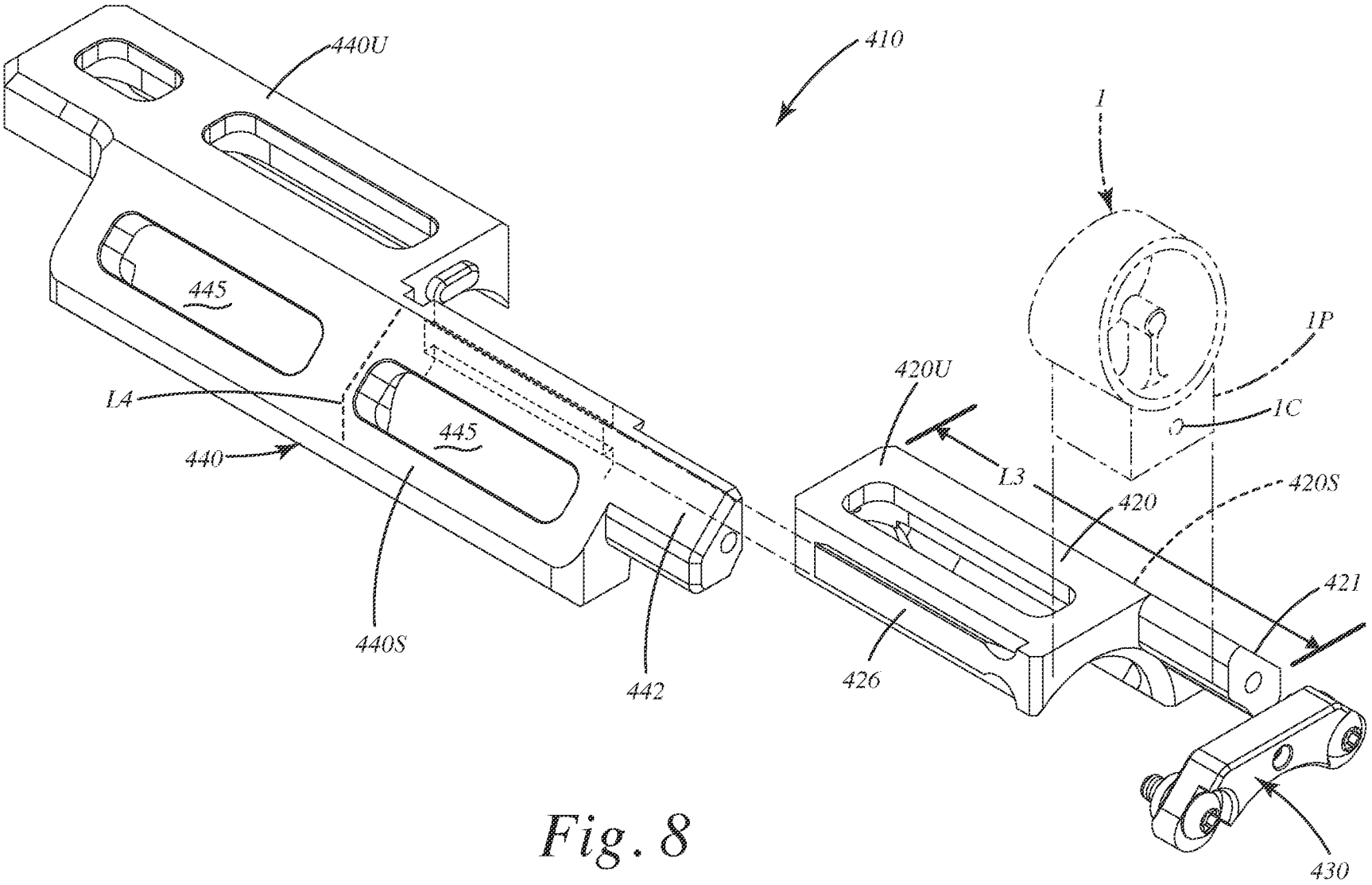
FIG. 8 is an exploded view of a fourth alternative embodiment of the mount showing a main body, an elongated modular body and a locking plate.

A fourth alternative embodiment of the mount is shown in FIG. 8 and generally designated 410. This mount can be similar to that of the current embodiment in structure, function and operation with several exceptions. For example, the mount 410 can include the main body 420 and a locking plate 430 secured thereto with fasteners, which generally clamp to the main post 1P of a front sight 1. In this embodiment, however, the main body 420 can be shorter than the main body 20 in the current embodiment. For example, the respective upper panel 420U and side panel 420S can be a length L3 that is substantially shorter than the length of those panels 20U and 20S in the current embodiment. These panels also can define fewer connectors, for example only one connector. In this embodiment, the modular body 440 can be larger than the modular body of the current embodiment 40 described above. It also can include an upper panel 440U that attaches to a side panel 440S to increase the overall mounting area of the modular body. Optionally, this modular body 440 can be shortened at the line LA so that the overall size of the mount is compact. Of course, the modular body and main body can be changed in size and shape, as well as connecting and interlocking with one another depending on the application.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

Reference throughout this specification to "a current embodiment" or "an embodiment" or "alternative embodiment" means that a particular feature, structure, or characteristic described in connection with the embodiment is included in at least one embodiment herein. Accordingly, the appearance of the phrases "in one embodiment" or "in an embodiment" or "in an alternative embodiment" in various places throughout this specification are not necessarily all referring to the same embodiment. Furthermore, the particular features, structures, or characteristics may be combined in any suitable manner with or in one or more embodiments.

What is claimed is:

1. A weapon mount configured to mount to a sight of a weapon, the mount comprising:

a main body including at least one connector configured to connect an accessory to the main body, a first engagement surface configured to engage a first sight surface of a sight of a weapon, and a first arm configured to extend forwardly adjacent and along a first lateral side of the sight of the weapon beyond the first engagement surface;

a locking plate including a second engagement surface that faces toward the first engagement surface, the second engagement surface configured to face a second sight surface of the weapon distal from the first sight surface, the locking plate defining a first hole through which a first fastener projects so that the first fastener extends parallel to a longitudinal axis of a barrel of the weapon, the first fastener joining the locking plate to the first arm, the locking plate defining a center plate hole distal from the first hole, the locking plate defining a second hole through which a second fastener projects so that the second fastener extends parallel to the longitudinal axis of the barrel of the weapon;

a centering fastener projecting through the center plate hole of the locking plate and configured to engage a center sight hole defined by the second sight surface of the sight of the weapon to center the locking plate relative to the sight; and a modular body joined with the main body and the locking plate on a second lateral side of the sight, the modular body extending parallel to the first arm, whereby a user can connect the accessory to the mount while the main body, arm, locking plate and modular body are disposed around and secured to the sight.

2. The weapon mount of claim 1, wherein the first sight surface and the second sight surface are transverse to one another, wherein the first arm is integrally formed with the main body to form a single piece unit.

3. The weapon mount of claim 2, wherein the first arm is perpendicular to the first engagement surface which forms a forward edge of the main body, wherein the center plate hole is threaded, wherein the center plate hole is between the first hole and the second hole, wherein the center plate hole, first hole and second hole each extend through and perpendicular to a common plane.

4. The weapon mount of claim 1, comprising:

a first elastomeric spacer disposed around the first fastener;

a second elastomeric spacer disposed around the second fastener;

wherein the first elastomeric spacer is located between the locking plate and the first arm, wherein the second elastomeric spacer is located between the locking plate and the modular body.

5. The weapon mount of claim 4, wherein the at least one connector comprises a plurality of slots defined through a plate of the main body.

6. The weapon mount of claim 1 comprising:

a first rail joined with the main body;

a second rail joined with the modular body, wherein the first rail and the second rail slidably join with one another.

7. The weapon mount of claim 6, wherein the first rail and the second rail include corresponding, interfitting elements that allow the modular body to slide forward toward the locking plate to thereby close the mount around the sight of the weapon.

8. The weapon mount of claim 1 comprising:

a guide rail and a guide rail slot joined with respective ones of the main body and the modular body, the guide rail and the guide rail slot slidably nested with one another to secure the main body and modular body to one another.

9. The weapon mount of claim 8, wherein the guide rail is a dovetail rail, wherein the guide rail slot is a dovetail recess that receives the dovetail rail.

10. The weapon mount of claim 1, wherein the locking plate includes a front surface, wherein the first hole, center plate hole and second hole are defined by the front surface, wherein the locking plate and front surface are perpendicular to the longitudinal axis of the barrel of the weapon.

11. A weapon mount configured to mount to a sight of a weapon, the mount comprising:

a main body including at least one connector configured to connect an accessory to the main body, a front edge, and a first arm extending forwardly of the front edge;

a locking plate facing toward the front edge and configured so a sight of the weapon is disposed between the front edge and the locking plate, the locking plate defining a first hole through which a first fastener projects, the first fastener joining the locking plate to the first arm, the locking plate defining a center plate hole distal from the first hole, the locking plate defining a second hole through which a second fastener projects, the first hole, second hole and center plate hole defined in a forward surface of the locking plate; and a centering fastener projecting through the center plate hole of the locking plate and configured to engage a center sight hole defined by the sight, whereby a user can connect the accessory to the mount while the main body, arm, and locking plate are disposed around and secured to the sight.

12. The weapon mount of claim 11, comprising:

a modular body joined with the main body and the locking plate opposite the first arm, the modular body extending parallel to the first arm.

13. The weapon mount of claim 12, comprising:

a first elastomeric spacer disposed around the first fastener;

a second elastomeric spacer disposed around the second fastener;

wherein the first elastomeric spacer is located between the locking plate and the first arm, wherein the second elastomeric spacer is located between the locking plate and the modular body.

14. The weapon mount of claim 12, wherein a guide rail and a guide rail slot are joined with respective ones of the main body and the modular body, wherein the guide rail and the guide rail slot are slidably nested with one another to secure the main body and modular body to one another.

15. The weapon mount of claim 11, wherein the center plate hole is threaded, wherein the center plate hole is between the first hole and the second hole, wherein the center plate hole, first hole and second hole each are intersected by a common plane.

16. The weapon mount of claim 11, wherein the main body includes an exterior surface defining a plurality of apertures that form the connector, wherein the main body includes an interior surface configured to receive a tube of the weapon located above a barrel of the weapon, wherein the main body includes a first lateral wing and a second lateral wing configured to extend laterally away from one another on opposite sides of the tube of the weapon, wherein a second arm extends forwardly of the front edge to the locking plate, wherein a second fastener extends through the locking plate and is threadably secured to the second arm, wherein the centering fastener includes a tapered point that is directed toward the sight, wherein the locking plate is planar with the first hole, second hole and center hole defined in a forward face of the locking plate.

* * * * *